US007765851B2

(12) United States Patent
Weschler

(10) Patent No.: US 7,765,851 B2
(45) Date of Patent: Aug. 3, 2010

(54) VEHICLE PANEL PULLING DEVICES

(76) Inventor: Bradley R. Weschler, 5 Skylark Ct., South Huntington, NY (US) 11746

( * ) Notice: Subject to any disclaimer, the term of this patent is extended or adjusted under 35 U.S.C. 154(b) by 0 days.

(21) Appl. No.: 11/642,494

(22) Filed: Dec. 20, 2006

(65) Prior Publication Data

US 2008/0148798 A1 Jun. 26, 2008

(51) Int. Cl.
*B21J 13/02* (2006.01)
*B21J 7/16* (2006.01)
*B21C 1/00* (2006.01)

(52) U.S. Cl. ..... 72/478; 72/394; 72/705

(58) Field of Classification Search ..... 72/478, 72/705, 479, 480, 394, 399; 294/97, 106, 294/82.1; 114/305; 279/35, 36, 37, 106, 279/107, 109; 269/48.1, 156, 237
See application file for complete search history.

(56) References Cited

U.S. PATENT DOCUMENTS 1,413,780 A * 4/1922 Rauch ..... 452/191
2,606,469 A * 8/1952 Morgenthaler ..... 72/392
2,701,539 A * 2/1955 Morel ..... 114/305
2,871,054 A * 1/1959 Zinke ..... 294/64.1
2,941,429 A * 6/1960 Mason ..... 72/457
2,951,725 A * 9/1960 St Jean ..... 294/97
3,100,336 A * 8/1963 Fannin ..... 72/324
3,641,805 A * 2/1972 Reinke ..... 72/460
3,793,977 A * 2/1974 Ziegler ..... 114/305
4,108,484 A * 8/1978 Malroit ..... 294/66.1
4,231,247 A * 11/1980 Haydon ..... 72/479
4,289,017 A * 9/1981 Guidry ..... 72/462
4,297,963 A * 11/1981 Beacom ..... 114/230.29
4,300,382 A * 11/1981 Meek ..... 72/478
4,476,705 A * 10/1984 Meek ..... 72/478
4,502,317 A * 3/1985 Hultquist ..... 72/479
4,770,025 A * 9/1988 Graf ..... 72/422
4,825,679 A * 5/1989 Cortinovis ..... 72/308
4,930,335 A * 6/1990 Ishihara ..... 72/451
5,247,824 A * 9/1993 Horan ..... 72/308
6,186,569 B1 * 2/2001 Heid ..... 294/95
6,526,796 B1 * 3/2003 Markarian ..... 72/293
6,948,751 B2 * 9/2005 Wooten et al. ..... 294/82.1
2005/0252271 A1 * 11/2005 Fredenberg et al. ..... 72/705

* cited by examiner

*Primary Examiner*—Dana Ross
*Assistant Examiner*—Teresa M Bonk
(74) *Attorney, Agent, or Firm*—Daniel P. Burke & Associates, PLLC

(57) ABSTRACT

A device for straightening a vehicle panel comprising a base which is attachable to a pulling device and at least three fingers pivotally connected to the base and movable from a retracted position designed for insertion into a drilled hole in a damaged panel. The fingers are movable to an extended position wherein a gripping portion extends generally perpendicular to the longitudinal pulling force. Another aspect comprises providing the gripping portion of at least one of the fingers with a substantially flat pulling surface in order to maximize the contact area between the finger and the damaged vehicle panel.

22 Claims, 13 Drawing Sheets

VEHICLE PANEL PULLING DEVICES

The present invention is directed to devices for repairing panels of vehicles after such panels have been damaged.

BACKGROUND OF INVENTION

Various devices have been previously disclosed for repairing panels of damaged vehicles, such as automobiles. Some previously disclosed methods involved welding a piece of metal to a damaged vehicle and then applying a pulling force to the welded metal tab. Alternative devices have been designed to be inserted into a relatively small hole which is drilled into the damaged vehicle panel. After partial insertion through the hole, the device was manipulated so that two fingers would spread out behind the drilled hole in order to engage the damaged portion of the panel to allow a pulling force to be applied.

As previously disclosed, panel repair devices suffered from several disadvantages. The use of a welded tab required extra work and, after the panel had been pulled, the tab had to be removed and the metal surface under the tab required repair to conceal where the welding had occurred. To the best of the present inventor's knowledge, the previously disclosed devices which were inserted through holes drilled in the metal disclose the use of two fingers which could be spread behind the drilled hole. Some such previously disclosed devices provided little surface area of contact between the straightening device and the inner side of the damaged panel, thereby putting unnecessary forces on relatively small sections of the damaged panel. Such devices would have a tendency to damage the panel with stretching forces, thus requiring additional repair. Moreover, the fact that such previously disclosed devices utilized two fingers resulted in the application of a pulling force generally along a line or a plurality of spaced lines, rather than in a plane.

SUMMARY OF THE INVENTION

Various embodiments of the present invention comprise a device for straightening a vehicle panel comprising a base which is attachable to a pulling device in order to exert forces of at least one, and preferably a plurality of directions. For purposes of reference, a pulling force can at least be applied in a longitudinal direction. The devices of this embodiment of the present invention also comprise at least three fingers pivotally connected to the base and movable from a retracted position designed for insertion into a drilled hole in a damaged panel, and movable to an extended position wherein gripping portions which extend generally perpendicular to a longitudinal pulling force are placed in contact with the back of the damaged panel.

Another aspect of the present invention comprises providing the gripping portion of at least one of the fingers with a substantially flat pulling surface in order to maximize the contact area between the finger and the damaged vehicle panel. The various embodiments of the present invention are designed to provide greater contact area around the hole through which the fingers are inserted in order to maximize the contact between the fingers and the area surrounding the circumference of the hole. The embodiments of the present invention are designed to avoid applying a force which is generally located along a line and which is more likely to create a crease in the panel when pulling forces are applied.

Most preferred embodiments of the present invention comprise at least three fingers wherein each of the fingers comprises a substantially flat pulling surface which engages the damaged vehicle panel during pulling.

It will be appreciated from the description below that the substantially flat pulling surface is on a proximal side of a finger relative to the pulling device (not shown). The distal side of the fingers, when the fingers are in the extended position, are preferably formed to minimize the cumulative cross-sectional area of all fingers when the fingers are in the retracted position in order to minimize the necessary size of a drilled hole in the damaged panel.

DETAILED DESCRIPTION

Figure 3:
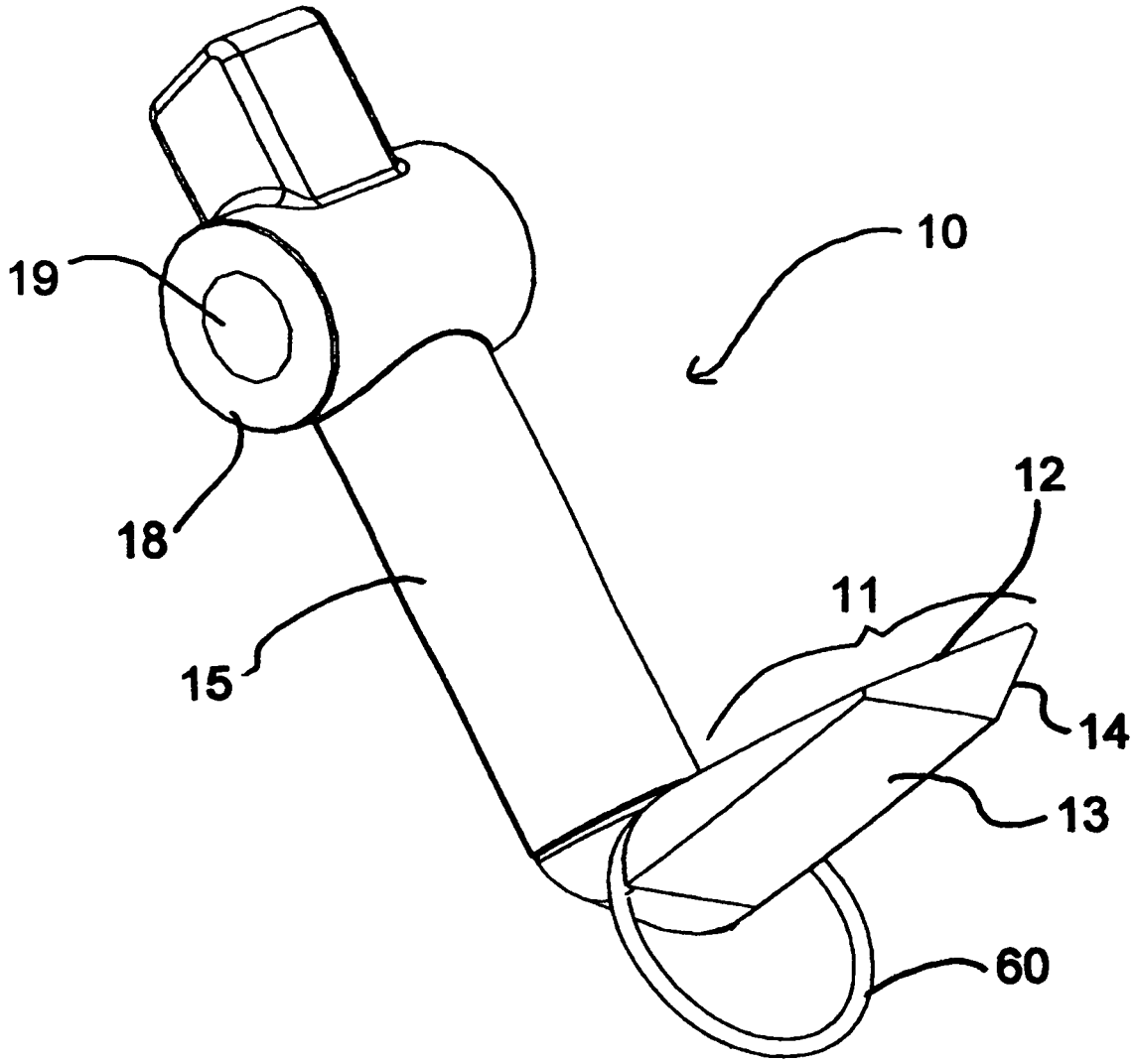
FIG. 3 is a perspective view of a finger and ring of the embodiment shown in FIG. 1.

The present invention is directed to a pulling device specifically adapted for applying one or more pulling forces to a damaged vehicle panel. The preferred illustrated embodiment shown in FIGS. 1-9 comprises three fingers 10 pivotally connected to a base 70. Each of the illustrated fingers 10 is connected to the base 70 by a connector bar 30 which is pivotally connected to a finger and to the base 70. With reference to FIG. 3, each finger 10 comprises a pulling portion 11 which is designed to engage the damaged panel portion being pulled. The pulling surface 12 of the pulling portion 11 is substantially flat in order to maximize the surface area of contact between each pulling finger 10 and the damaged vehicle portion.

With reference again to FIG. 1, connector bar 30 receives a pin 20 for pivotally receiving a finger 10 at a distal region thereof while in a more proximal region, a second pin 40 pivotally connects the connector bar 30 to a protrusion 72 on base 70.

The shape of the illustrated fingers is shown more clearly in FIG. 3. Each finger 10 is generally L-shaped and comprises a pulling portion 11 having a generally flat pulling surface 12 and a generally V-shaped distal portion formed by faces 13, 14. Pulling portion 11 is preferably integrally formed with extension section 15, the top of which comprises a connector barrel 18 having a through hole 19 adapted to receive a pin 20 for pivotally connecting finger 10 to connector bar 30. Alternatively, one or more portions of the fingers can be separately formed and assembled prior to sale or use.

Figure 4:
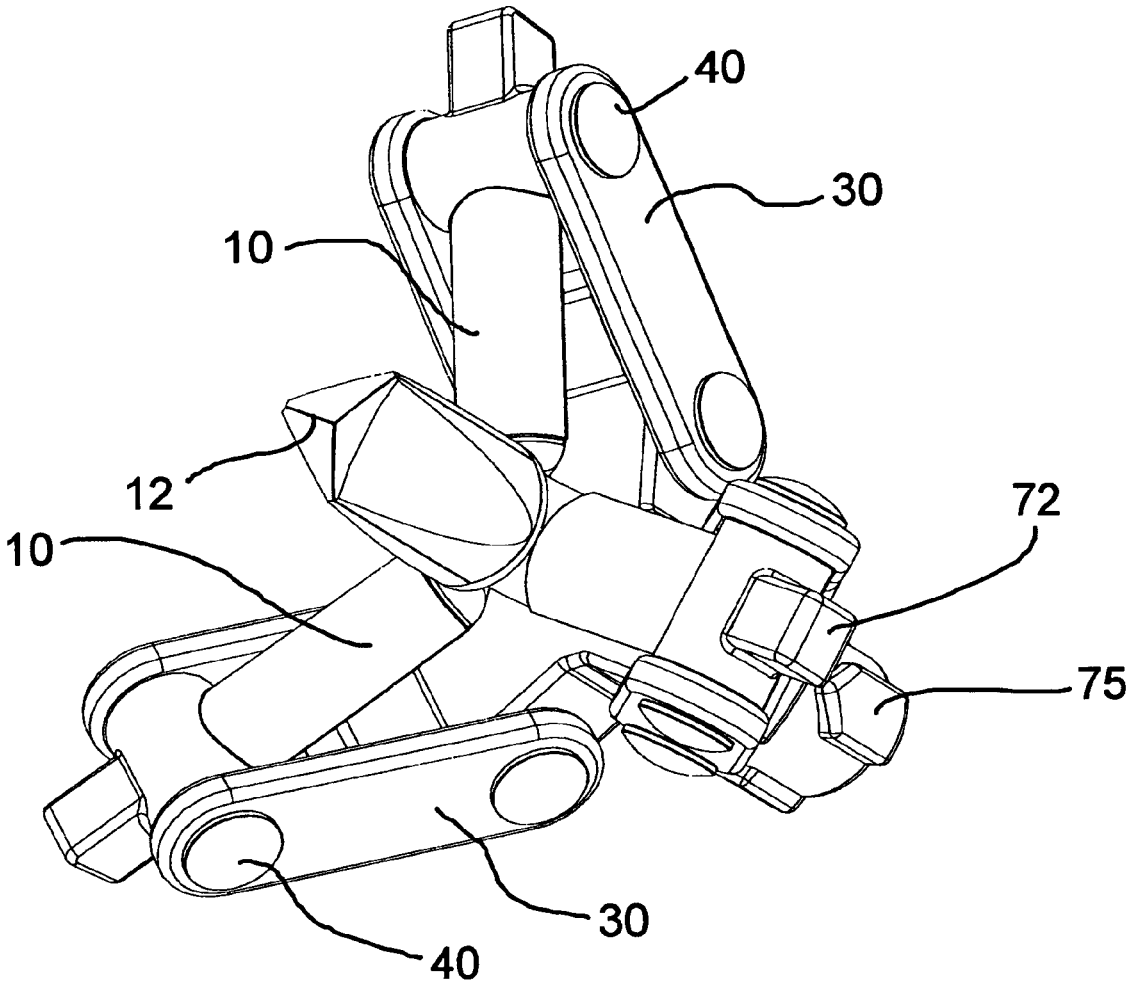
FIG. 4 is a bottom perspective view of the device shown in FIG. 1 with the fingers in a retracted position.

The pulling portions 11 of the fingers 10 are preferably designed to form a minimal cross-sectional dimension when the fingers are in the retracted position shown in FIG. 4 thereby minimizing the necessary size of a hole through which the fingers 10 may be inserted. In the preferred illustrated embodiment, and as best shown in FIGS. 3 and 4, each distal portion of pulling portion 11 is generally V-shaped, creating a generally triangular cross-section for the pulling portion 11. As shown in FIG. 4, this configuration permits the three fingers to fit snugly together. The illustrated V-shaped cross-section of pulling portion 11 is designed to maximize strength and advantageously lacks any hollowed out areas which could weaken the integrity of the fingers.

Figure 5:
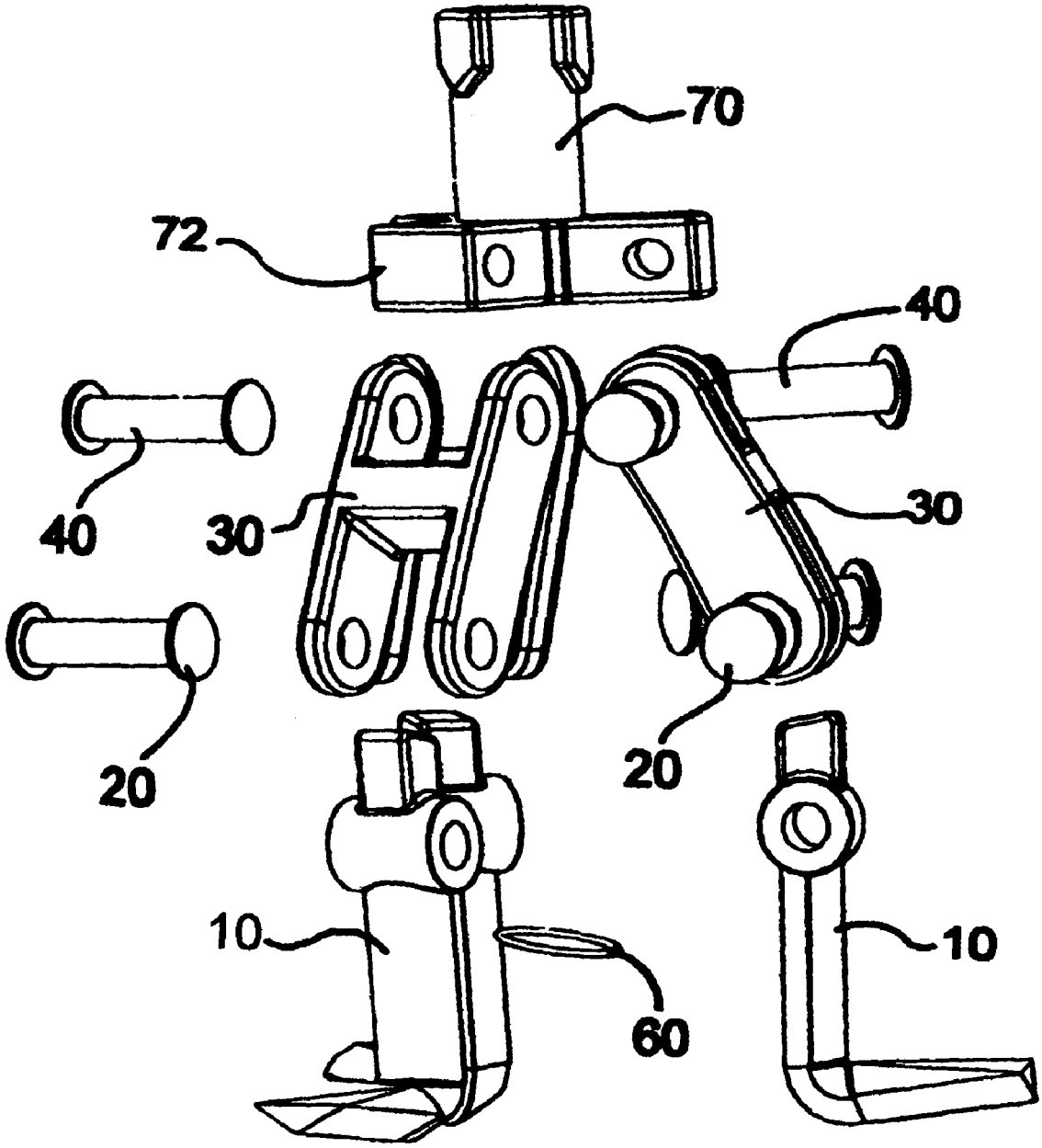
FIGS. 5 and 6 are exploded perspective views of the device shown in FIG. 1.
Figure 6:
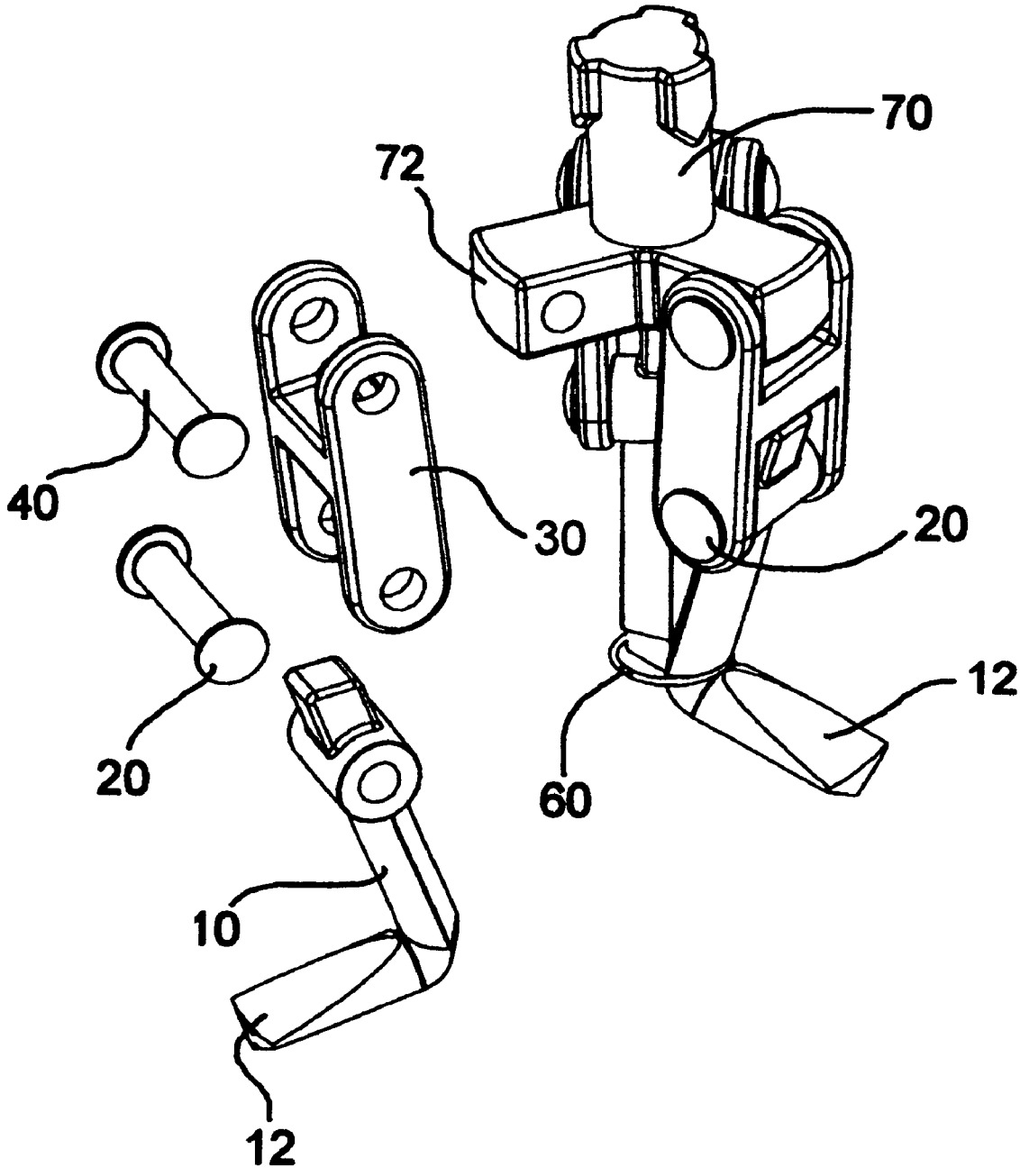

The shape of the illustrated connector bar 30 is best shown in the exploded view of FIG. 5. The illustrated connector bars 30 are generally H-shaped and comprise two sets of through holes at either end for receiving pin 20 to pivotally connect finger 10 to the connector bar 30 and for receiving pin 40 for pivotally connecting the connector bar 30 to protruding section 72 of base 70.

Figure 1:
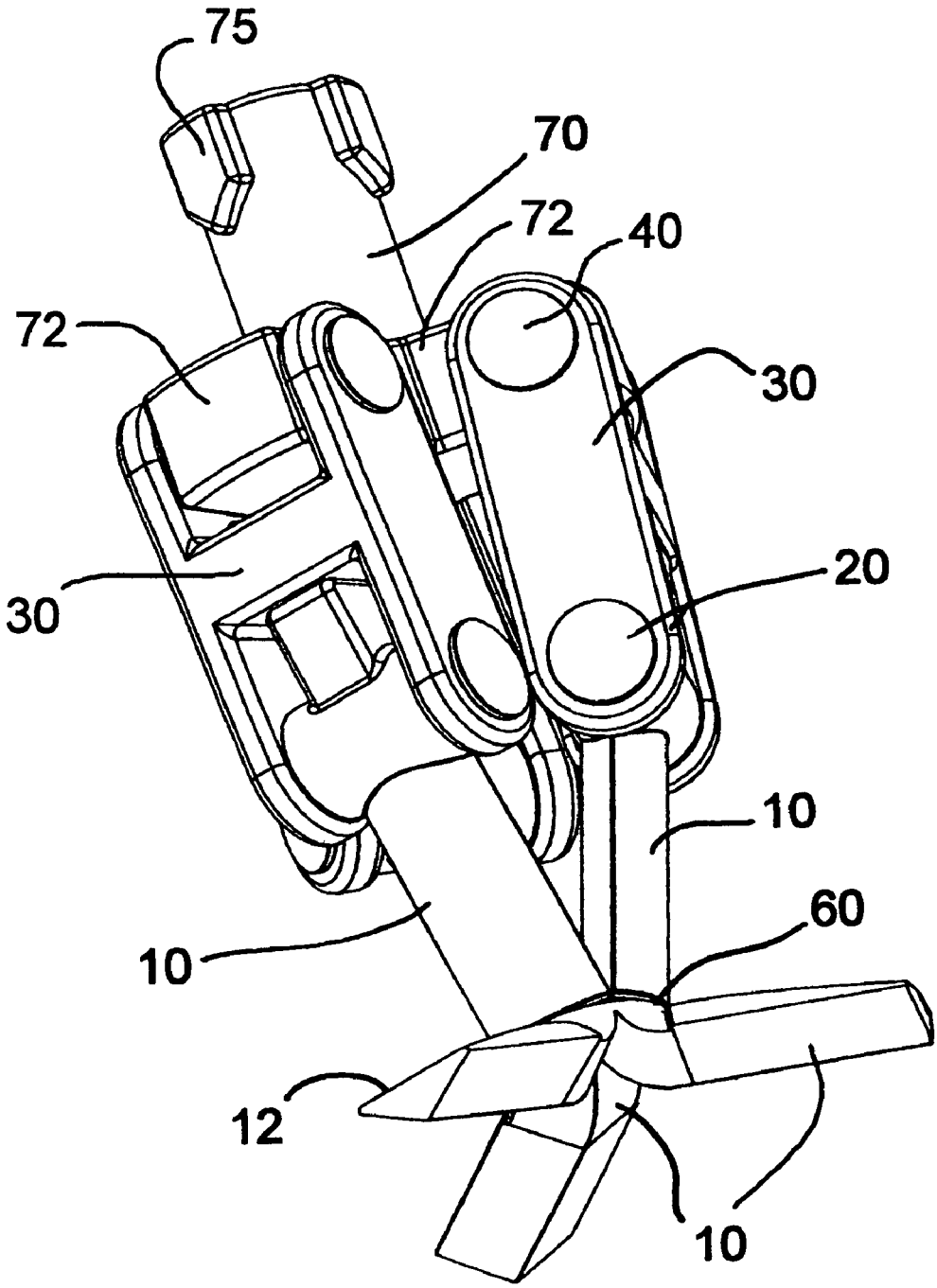
FIG. 1 illustrates a perspective view of one preferred embodiment of the present invention with the fingers in the extended position.
Figure 2:
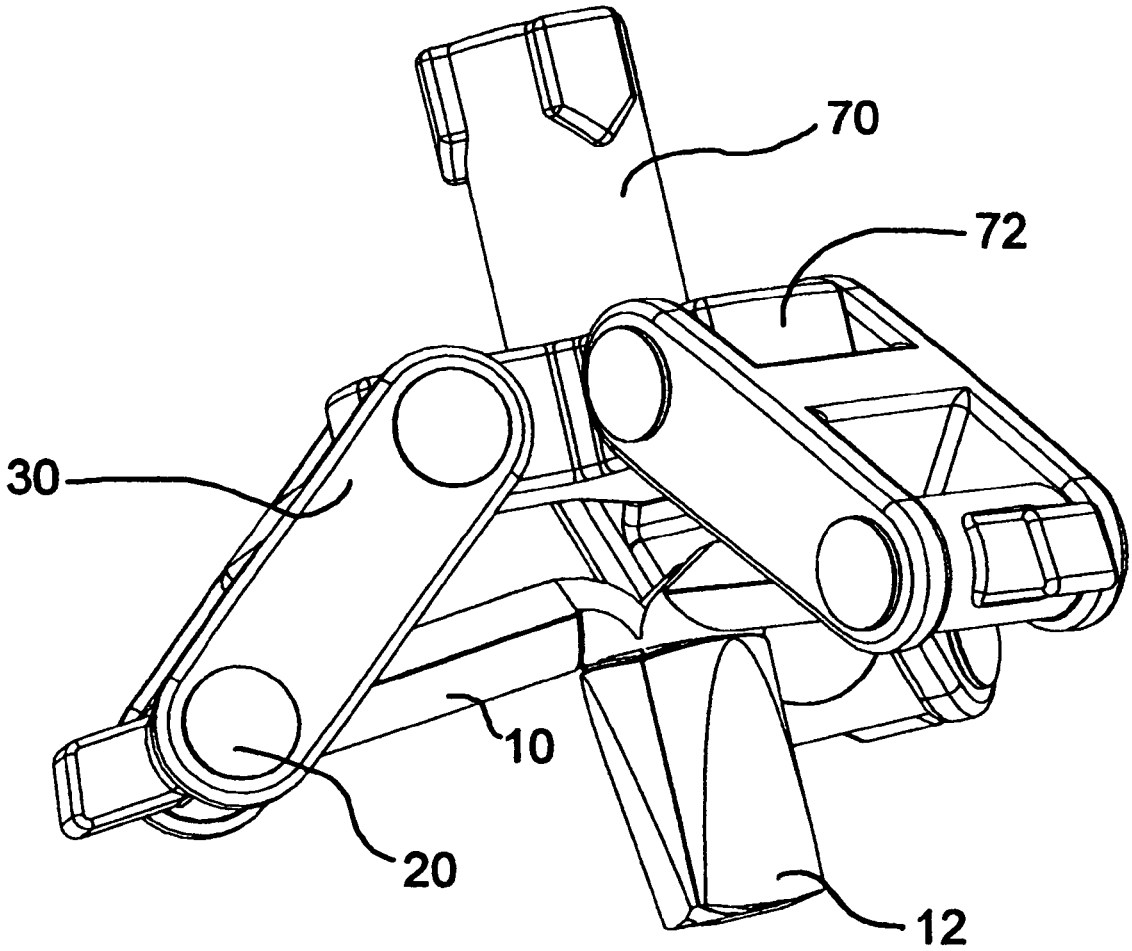
FIG. 2 is a perspective view of the embodiment shown in FIG. 1 with the fingers in a retracted position.

In order to maintain the bases of the fingers in close proximity, particularly during alignment with a drilled hole and during movement of the fingers from the retracted position shown in FIG. 4 to the extended position shown in FIG. 1, a resilient ring 60 is advantageously positioned around the base of the fingers. The positioning of ring 60 is shown in FIG. 1.

Figure 7:
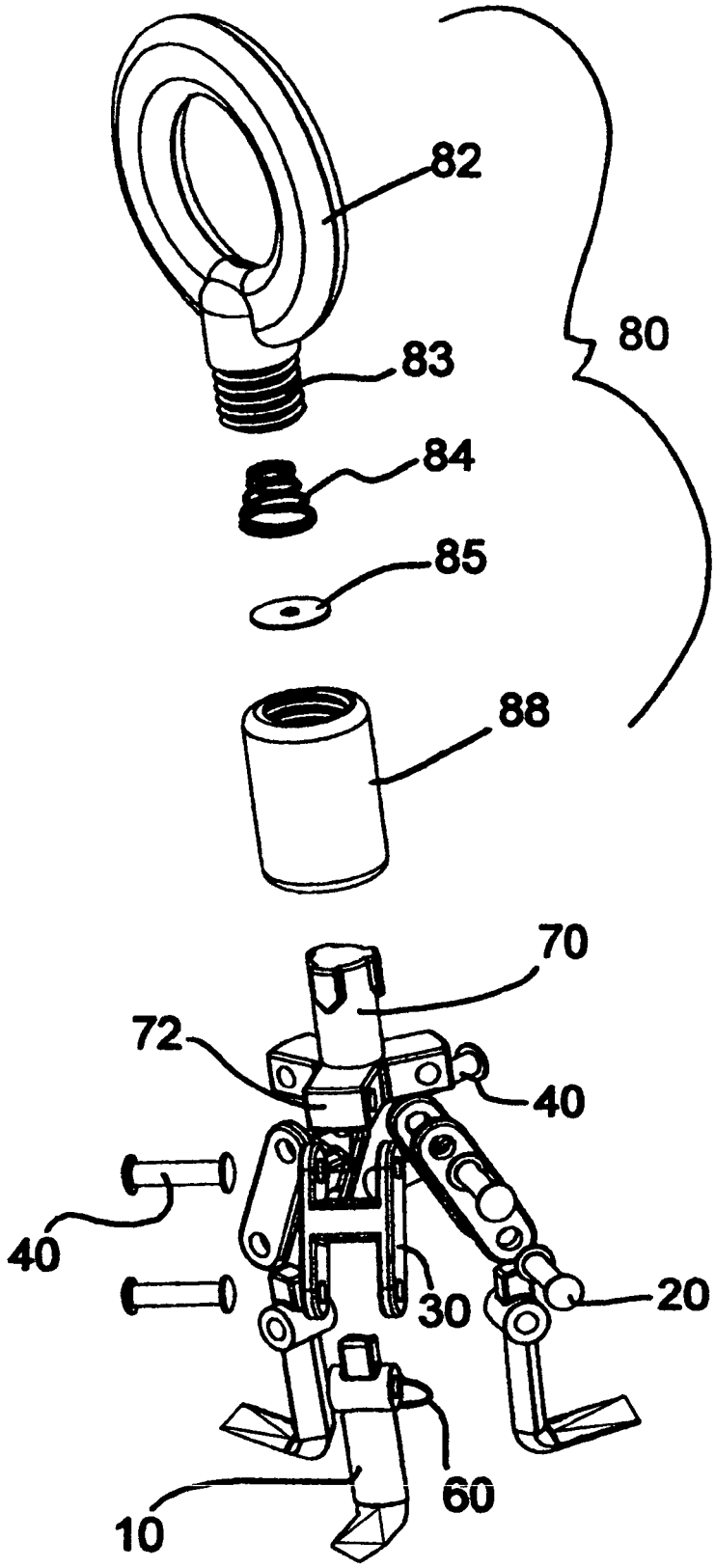
FIG. 7 is an exploded view of the embodiment shown in FIG. 1 shown with a spring loaded attachment ring.
Figure 8:
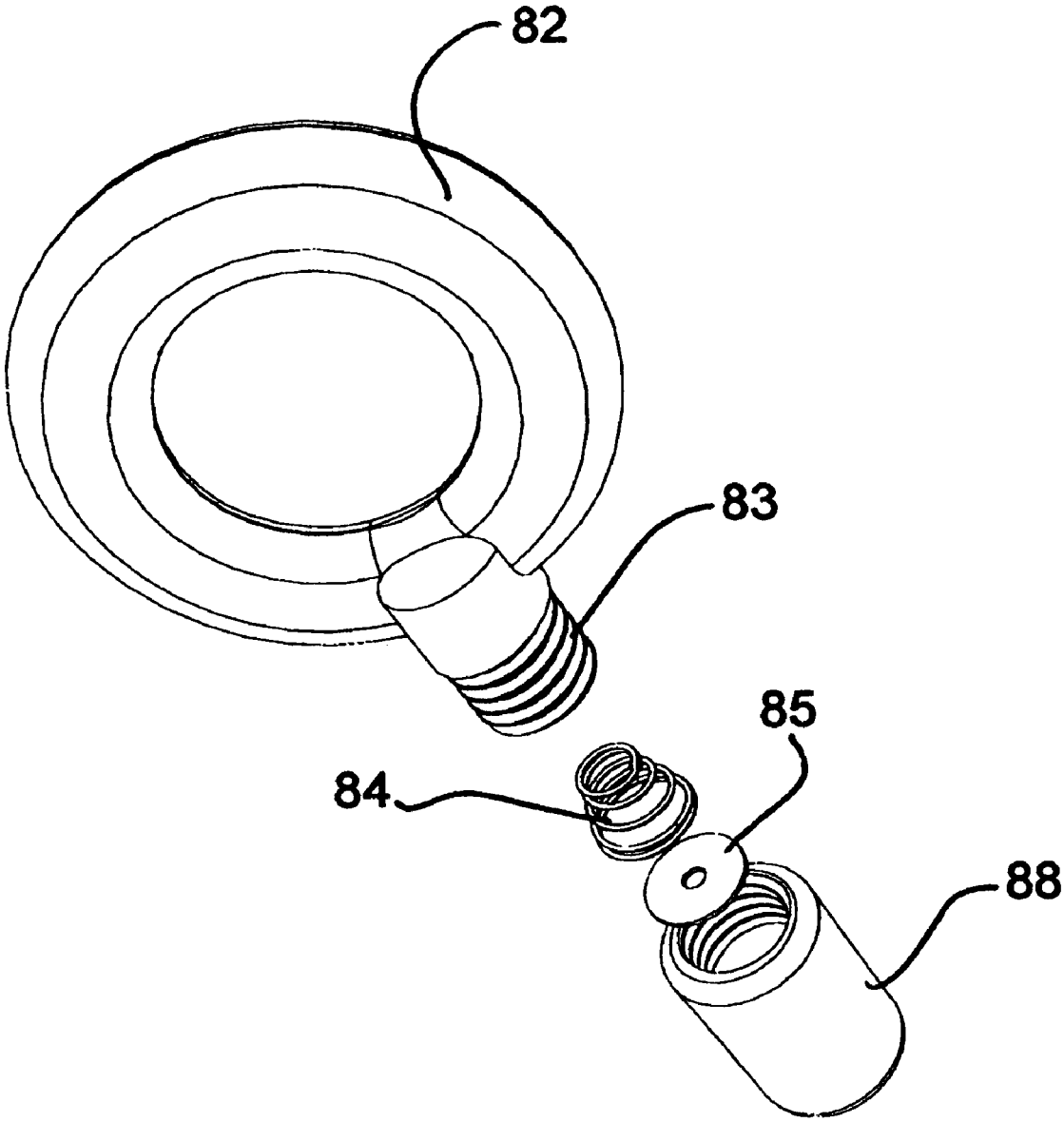
FIG. 8 is an exploded view of the attachment ring shown in FIG. 7.
Figure 9:
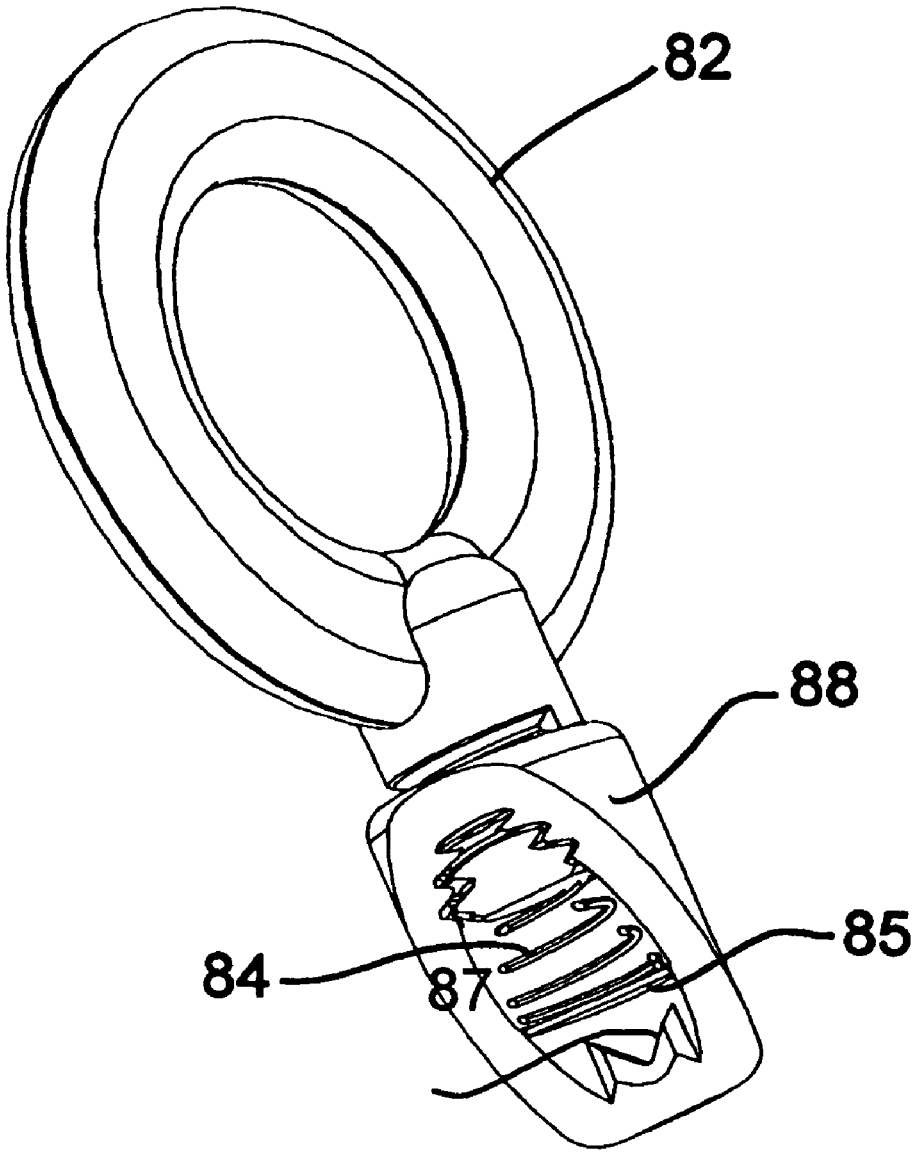
FIG. 9 is a partial, cross-sectional view of the attachment ring shown in FIG. 7.

FIGS. 7, 8 and 9 illustrate a selectively removable attachment ring 80 comprising a ring section 82 having a threaded connector 83 adapted to be threadably received within a bayonette-type barrel 88. Illustrated barrel 88 is internally threaded to threadably receive the threaded connection 83 of ring 82. Additionally, a coil spring 84 and a movable plate 85 are positioned in barrel 88.

As best shown in the partial cross-sectional view of FIG. 9, internally threaded barrel 88 also comprises a plurality of notched recesses 87 which are shaped to complement and snugly receive the shaped protrusions 75 on base 70 (shown in FIG. 7). From the drawings, it will be appreciated that when the proximal portion of base 70 comprising protrusions 75 is inserted into threaded barrel 88 against the biasing force of coil spring 84, and then rotated to align the protrusion 75 of base 70 with notched recesses 87, the force of coil spring 84 will urge the protrusion 75 into recesses 87 and maintain the ring 82 in connection with the remainder of the base 70.

Figure 10:
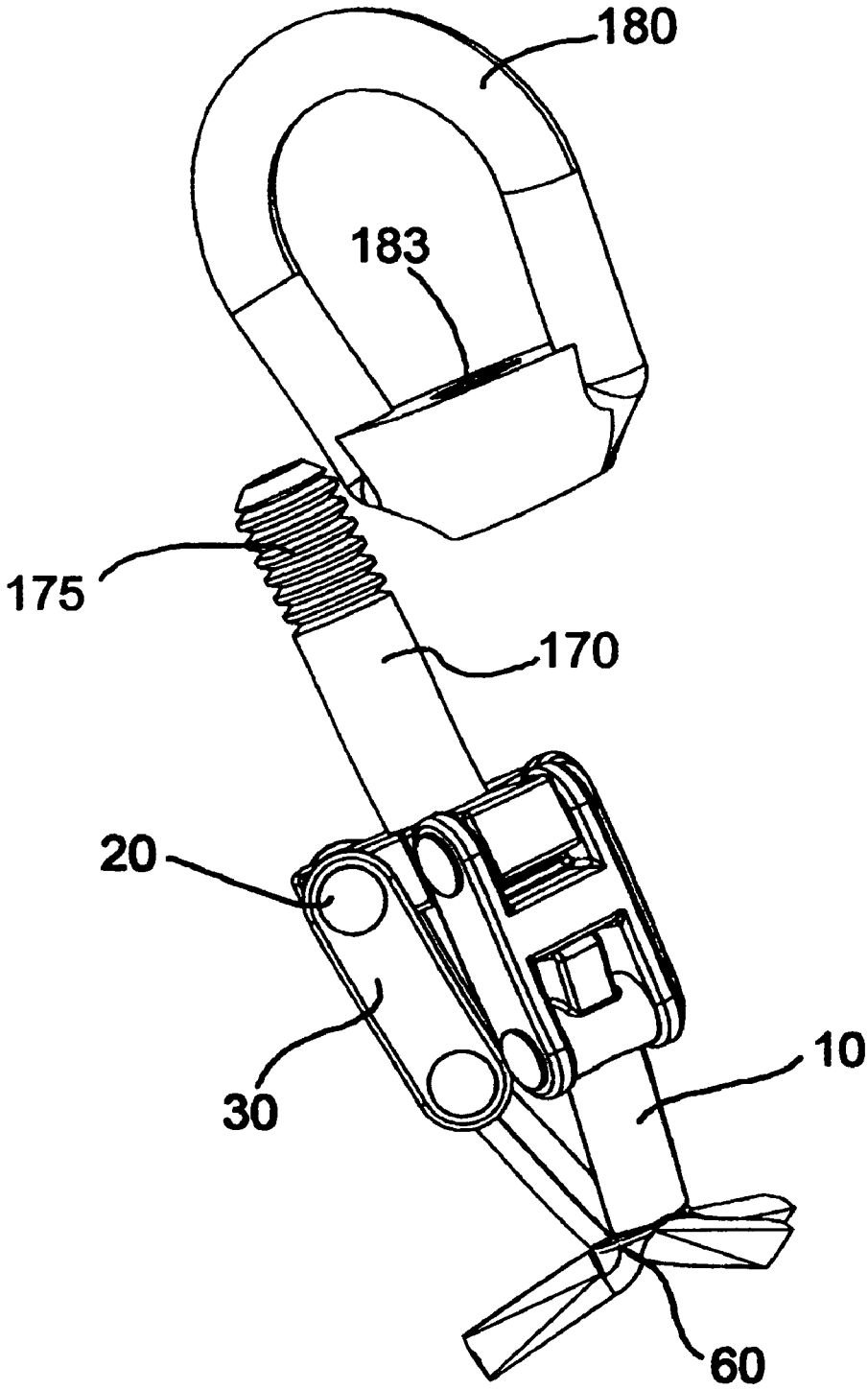
FIG. 10 illustrates an alternative embodiment of the present invention.

FIG. 10 illustrates an alternative embodiment of the present invention wherein attachment ring 180 comprises a threaded hole 183. According to this illustrated embodiment of the present invention, base 170 comprises a threaded proximal section 175 which is simply screwed into the threaded hole 183 of attachment ring 180.

Figure 11:
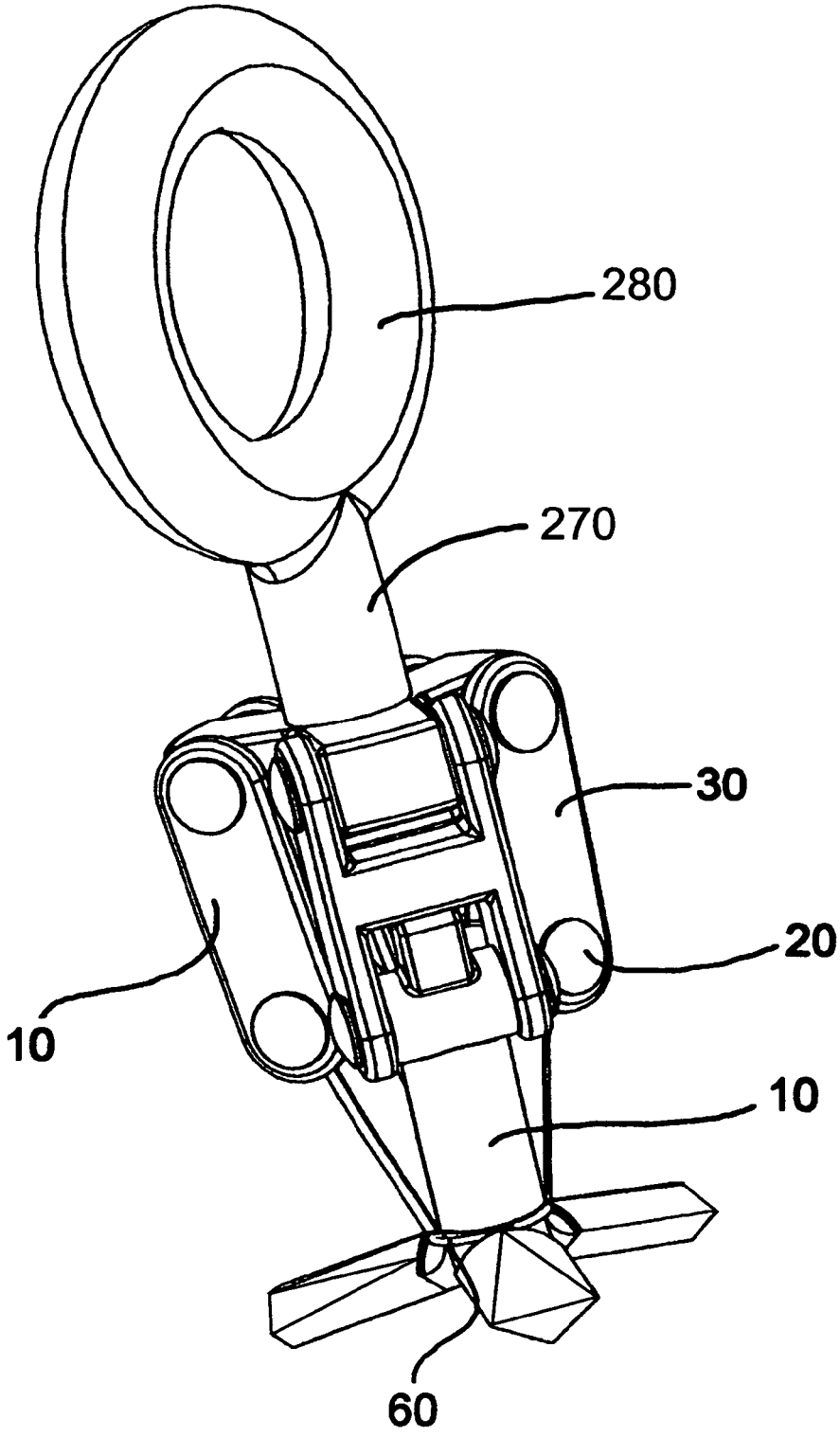
FIG. 11 illustrates a still further embodiment of the present invention.

FIG. 11 illustrates a still further embodiment of the present invention wherein attachment ring 280 is integrally formed with base 270.

Figure 12:
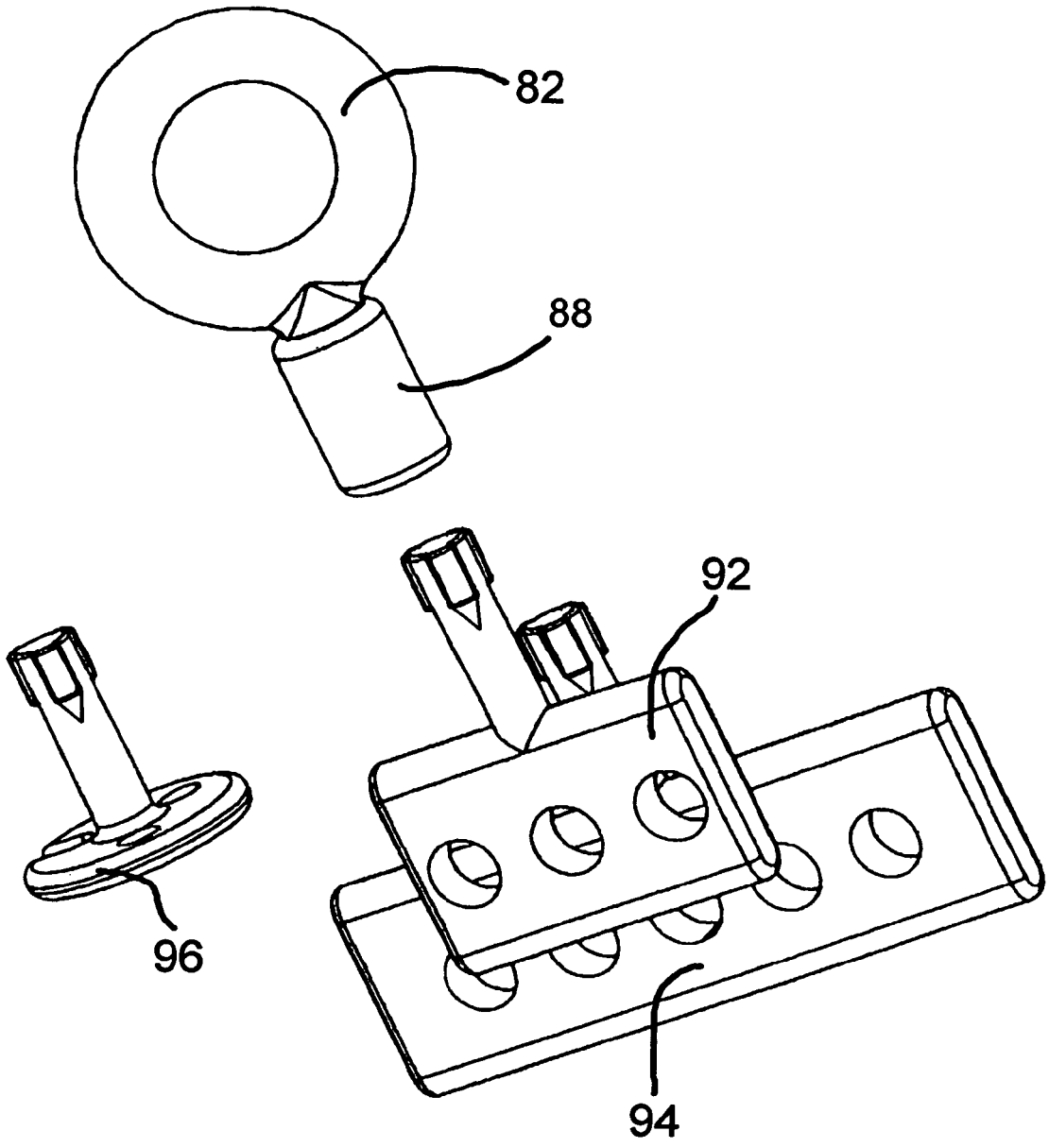
FIG. 12 illustrates alternative attachment accessories useful for vehicular repair with a spring loaded ring of the type shown in FIG. 9.
Figure 13:
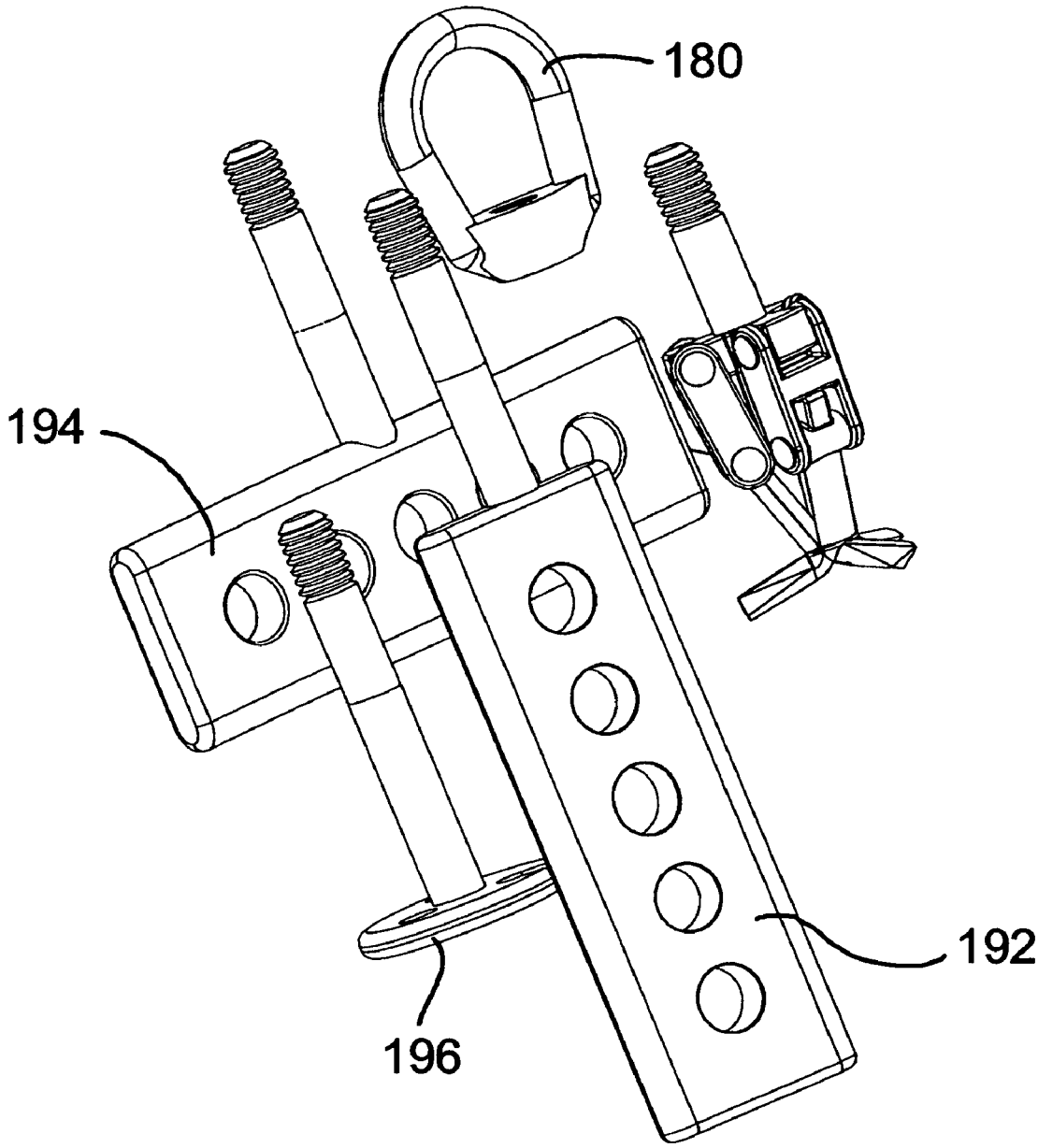
FIG. 13 illustrates a still further embodiment of the present invention.

The selectively releasable ring 80 shown in FIGS. 7-9 is also suitable for connection with other pulling accessories such as pulling bars and valve-shaped pulling attachments as shown in FIGS. 12-14. Connector ring 80 is particularly suited for receiving other shapes of adapters such as a four inch bar 92, a six inch bar 94, or a valve-shaped pulling attachment 96. The illustrated bars are advantageously provided with bayonet-type connections similar to the connections 75 illustrated on FIG. 1. These bayonet-type connections provide ready connections between the attachment ring 80 and these alternate pulling connectors.

As shown in FIG. 13 the attachment ring can be threadably connected to the alternative attachments in a manner similar to the embodiment shown in FIG. 10.

The present invention is particularly suited for both heavy and thin gauge steel or other metallic panels, such as rocker panels.

I claim:

1. A device for straightening a vehicle panel comprising:

a base comprising means for attaching a pulling device to exert a force in at least one direction including a longitudinal direction;

at least three, generally L-shaped fingers pivotally connected to said base and movable from a retracted position to an extended position;

each of said fingers comprising an extension portion and a pulling portion, said pulling portion comprising a separate gripping surface such that said device comprises at least three separate gripping surfaces; and at least one connector bar for connecting said fingers to said base, said connector bar comprising a first portion pivotally connected to said base and a second portion pivotally connected to at least one of said fingers.

2. A device for straightening a vehicle panel according to claim 1 wherein at least one of said fingers comprises a substantially flat pulling surface for engaging a vehicle panel.

3. A device for straightening a vehicle panel according to claim 2 wherein at least two of said fingers comprise substantially flat pulling surfaces for engaging a vehicle panel.

4. A device for straightening a vehicle panel according to claim 2 wherein at least three of said fingers comprise substantially flat pulling surfaces for engaging a vehicle panel.

5. A device for straightening a vehicle panel according to claim 1 wherein said fingers are configured to nestle when in said retracted position.

6. A device for straightening a vehicle panel according to claim 1 wherein said fingers comprise a generally triangular cross-section.

7. A device for straightening a vehicle panel according to claim 1 comprising three of said connector bars wherein each connector bar pivotally connects one of said fingers to said base.

8. A device for straightening a vehicle panel according to claim 1 wherein said attaching means comprises a spring-loaded connection.

9. A device for straightening a vehicle panel according to claim 1 wherein said attaching means comprises a ring.

10. A device for straightening a vehicle panel according to claim 9 wherein said ring comprises a spring-loaded connector for releasably attaching said ring to a portion of said base.

11. A device for straightening a vehicle panel according to claim 9 wherein said ring is threadably attachable to a portion of said base.

12. A device for straightening a vehicle panel according to claim 9 wherein said ring is integrally formed with other portions of said base.

13. A device for straightening a vehicle panel according to claim 1 further comprising a ring for maintaining at least portions of said fingers in close proximity.

14. A device for straightening a vehicle panel according to claim 1 wherein said attaching means is releasably attached to said base by a spring-loaded connector which is selectively engagable and disengagable.

15. A device for straightening a vehicle panel according to claim 14 wherein said attaching means comprises a ring.

16. A device for straightening a vehicle panel according to claim 1 wherein said ring comprises a spring-loaded connector for releasably attaching said ring to a portion of said base.

17. A device for straightening a vehicle panel according to claim 1 further comprising a ring for maintaining at least portions of said fingers in contact with each other.

18. A device for straightening a vehicle panel according to claim 1 wherein said gripping surfaces extend generally in said longitudinal direction when said fingers are in said retracted position and said gripping surfaces extend generally perpendicular to a longitudinal pulling force when said fingers are in said extended position.

19. A device for straightening a vehicle panel according to claim 1 wherein each of said pulling portions extend in different directions from their respective extension portions when said fingers are in said extended position.

20. A device for straightening a vehicle panel comprising:

a base comprising means for attaching a pulling device to exert a force in at least one direction including a longitudinal direction;

at least three, generally L-shaped fingers pivotally connected to said base and movable from a retracted position to an extended position;

each of said fingers comprising a separate gripping surface which extends generally perpendicular to a longitudinal pulling force when said fingers are in said extended position; and at least one connector bar for connecting said fingers to said base, said connector bar comprising a first portion pivotally connected to said base and a second portion pivotally connected to at least one of said fingers.

21. A device for straightening a vehicle panel according to claim 20 wherein said attaching means comprises a spring-loaded connector.

22. A device for straightening a vehicle panel comprising:

a base comprising means for attaching a pulling device to exert a force in at least one direction including a longitudinal direction;

at least three, generally L-shaped fingers pivotally connected to said base and movable from a retracted position to an extended position;

each of said fingers comprising a separate gripping surface which extends generally perpendicular to a longitudinal pulling force when said fingers are in said extended position;

wherein said attaching means comprises a ring comprising a spring-loaded connector for releasably attaching said ring to a portion of said base; and at least one connector bar for connecting said fingers to said base, said connector bar comprising a first portion pivotally connected to said base and a second portion pivotally connected to at least one of said fingers.

* * * * *